US012740642B2

(12) United States Patent
Wang

(10) Patent No.: US 12,740,642 B2
(45) Date of Patent: Sep. 22, 2026

(54) BIDIRECTIONAL FLIPPING MECHANISM FOR FLIPPING TV CABINET AND A FLIP TV CABINET

(71) Applicant: Fuding Wenzhang Intelligent Technology Co., Ltd., Ningde (CN)

(72) Inventor: Guangwen Wang, Ningde (CN)

(73) Assignee: FUDING WENZHANG INTELLIGENT TECHNOLOGY CO., LTD., Ningde (CN)

( * ) Notice: Subject to any disclaimer, the term of this patent is extended or adjusted under 35 U.S.C. 154(b) by 369 days.

(21) Appl. No.: 18/450,947

(22) Filed: Aug. 16, 2023

(65) Prior Publication Data

US 2024/0407548 A1 Dec. 12, 2024

(30) Foreign Application Priority Data

Jun. 8, 2023 (CN) ..... 202321454722.5

(51) Int. Cl.
*A47B 81/06* (2006.01)

(52) U.S. Cl.
CPC ..... *A47B 81/065* (2013.01); *A47B 81/062* (2013.01); *A47B 2220/0091* (2013.01)

(58) Field of Classification Search
CPC ..... A47B 81/065; A47B 81/062; A47B 2220/0091
USPC ..... 312/7.2, 319.5–319.8, 21–30
See application file for complete search history.

(56) References Cited

U.S. PATENT DOCUMENTS 2,121,910 A * 6/1938 Freimann ..... G03B 21/30 312/10.1
2,143,218 A * 1/1939 Thurner ..... A47B 21/02 312/24
2,350,889 A * 6/1944 Harman ..... A47B 81/065 348/827
2,413,922 A * 1/1947 Jensen ..... H04N 5/64 348/827
3,575,483 A * 4/1971 Church ..... E06B 3/385 312/328
3,880,507 A * 4/1975 Adams, Jr. ..... G03B 31/06 353/119
4,245,256 A * 1/1981 Kokubo ..... H04N 9/3141 348/789
4,281,352 A * 7/1981 Hoffman ..... H04N 9/3141 348/E5.143

(Continued)

*Primary Examiner* — Daniel J Troy
*Assistant Examiner* — Timothy M Ayres
(74) *Attorney, Agent, or Firm* — INNOVATION CAPITAL LAW GROUP, LLP; Vic Lin

(57) ABSTRACT

The present disclosure discloses a bidirectional flipping mechanism for a flip TV cabinet and a flip TV cabinet. The bidirectional flipping mechanism includes a driving unit mounted on a mounting base for driving at least one of a first flipping member and a second flipping member to respectively pivot around a first pivot shaft and a second pivot shaft with respect to the mounting base, and thus when the bidirectional flipping mechanism is applied to the flip TV cabinet, an upper part of a vertically placed laser TV on the support plate and the top of the support plate can be as close as possible to the top plate of a cabinet body of the flip TV cabinet, so as to reduce a total height of the cabinet body and avoid a large gap between the support plate and the top plate.

13 Claims, 13 Drawing Sheets

(56) References Cited

U.S. PATENT DOCUMENTS 4,386,372 A * 5/1983 Slater ..... H04N 9/3141 348/E5.143
4,400,736 A * 8/1983 Weiss ..... H04N 9/3141 348/789
4,639,106 A * 1/1987 Gradin ..... H04N 9/3141 348/E5.143
4,750,832 A * 6/1988 Lloyd, Sr. ..... F16M 11/10 352/104
4,941,718 A * 7/1990 Alexander, III ..... G01S 13/931 296/37.7
5,211,456 A * 5/1993 Staffaroni ..... A47B 46/005 108/134
7,178,469 B2 * 2/2007 Goza ..... A47B 21/0314 108/50.01
8,061,789 B2 * 11/2011 Krueger ..... A47B 46/005 211/100
8,246,181 B2 * 8/2012 Davis ..... G03B 29/00 353/122
8,596,728 B2 * 12/2013 Rozestraten ..... A47B 81/061 312/7.2
8,662,605 B2 * 3/2014 McRorie ..... A61B 50/13 108/50.01
8,696,076 B2 * 4/2014 Karg ..... E06B 3/482 312/109
12,007,062 B1 * 6/2024 Leman ..... F16M 11/10
2006/0017356 A1 * 1/2006 Hoss ..... A47B 81/06 312/319.7
2007/0000414 A1 * 1/2007 Riddiford ..... A47B 21/0073 108/50.01
2008/0042527 A1 * 2/2008 Chen ..... A47B 21/0073 312/24
2008/0116771 A1 * 5/2008 Green ..... A47B 81/06 312/7.2
2013/0257236 A1 * 10/2013 Head ..... A47B 51/00 312/204

* cited by examiner

BIDIRECTIONAL FLIPPING MECHANISM FOR FLIPPING TV CABINET AND A FLIP TV CABINET

TECHNICAL FIELD

The present disclosure relates to the technical field of daily necessities, and specifically to a bidirectional flipping mechanism for a flip TV cabinet and a flip TV cabinet.

BACKGROUND

Currently, common hidden TV cabinets for laser TVs (i.e., a new type of TV cabinet that can hide the laser TV inside when not in use) on the market mainly include sliding TV cabinets and front plate flip TV cabinets.

However, these two common TV cabinets have the problems of occupying large space and/or being unsightly. The main reason for these problems is that for the sliding TV cabinet, due to the limitation of the width of the laser TV, the depth (i.e., width) of the sliding TV cabinet is relatively large because it mainly uses a sliding drawer structure set on the cabinet to lay the laser TV flat (when using and not using the laser TV). Moreover, in order to improve the sound transmission of the laser TV installed in the sliding TV cabinet, it is also necessary to set a through hole in the front of the drawer structure, which reduces the aesthetics of the sliding TV cabinet. For the front plate flip TV cabinet, it mainly uses a flipping drawer structure (including the front plate) set on the cabinet to place the laser TV vertically (when not using the laser TV). When the laser TV needs to be used, it can be used as long as the drawer structure is flipped forward to make the laser TV horizontally placed. However, due to the height (thickness) of the laser TV, when it is placed vertically, the upper part of the laser TV (i.e., the front part of the laser TV when placed flat) cannot be close to the top plate of the cabinet. This causes a large gap between the upper part of the vertically placed laser TV and the top plate of the cabinet, resulting in a higher height of the cabinet. When the front plate of the flipping drawer structure is flush with the upper part of the vertically placed laser TV, there will be a gap between the front plate and the top plate (as shown in FIGS. 14 to 16), which reduces the aesthetics of the cabinet. When the front plate of the flipping drawer structure is against the top plate, it will cause the flipping drawer structure to extend a large distance relative to the cabinet body when flipped to make the laser TV horizontally placed (as shown in FIG. 17 to FIG. 19), which not only occupies a large space but also has low aesthetics.

SUMMARY

In order to solve at least one of the problems of high cost and energy consumption, as well as the problems of high installation accuracy requirements and large space occupation when synchronously flipping two or more components in the prior art, a bidirectional flipping mechanism for a flip TV cabinet is provided according to an aspect of the present disclosure.

The bidirectional flipping mechanism for a flip TV cabinet includes: a mounting base, a first flipping member mounted on the mounting base and pivotable around a first pivot shaft, a second flipping member mounted on the mounting base and pivotable around a second pivot shaft, and a driving unit mounted on the mounting base, wherein the driving unit is used to drive the first flipping member to pivot around the first pivot shaft, and/or drive the second flipping member to pivot around the second pivot shaft.

When the bidirectional flipping mechanism is applied to the flip TV cabinet, a cover plate (i.e., a top plate) of the TV cabinet can be fixed relative to the first flipping member, and a support plate of the TV cabinet (which can support a laser TV when the support plate is placed horizontally) can be fixed relative to the second flipping member. Since it is possible to drive the first flipping member to pivot around the first pivot shaft relative to the mounting base and/or drive the second flipping member to pivot around the second pivot shaft relative to the mounting base by the driving unit, an upper part of the laser TV placed vertically on the support plate can be as close as possible to the top plate of the cabinet, reducing the total height of the cabinet. At the same time, when the support plate is placed vertically, the top of the support plate can also be as close as possible to the top plate of the cabinet, avoiding a large gap between the support plate and top plate, thus ensuring the aesthetics of the cabinet. Moreover, as a flip TV cabinet, there is no problem of large cabinet depth and reduced aesthetics due to setting the through hole in the front.

According to another aspect of the present disclosure, a flip TV cabinet is provided. The flip TV cabinet includes a cabinet body, a bidirectional flipping mechanism for the flip TV cabinet, which has a mounting base fixed relative to the cabinet body and a second flipping member provided at a side of the cabinet body, a cover plate fixed relative to a first flipping member of the bidirectional flipping mechanism, and a support plate fixed relative to the second flipping member, wherein, the bidirectional flipping mechanism for the flip TV cabinet is the aforementioned bidirectional flipping mechanism for the flip TV cabinet.

Accordingly, under the driving of the driving unit of the bidirectional flipping mechanism for the flip TV cabinet, the cover plate and support plate can be synchronously flipped by respectively driving the first and second flipping members, and the laser TV can be placed on the support plate.

REFERENCE SIGNS

20/20/20": Mounting Base
31: First Pivot Shaft
311: Pipe Hinge
32/32: Second Pivot Shaft
33/33: Third Pivot Shaft
34/34': Fourth Pivot Shaft
35: Fifth Pivot Shaft
36: Sixth Pivot Shaft
41/41'/41": First Flipping Member
42/42/42": Second Flipping Member
50/50': Driving Unit
501: First Driving Unit
502: Second Driving Unit
51/51': Cylinder Base
52/52': Piston Rod
60: Transmission Mechanism
70/70'/70": Cabinet Body
701: First Accommodating Cavity
702: Side Opening
71/71'/71": Cover Plate
72/72/72": Support Plate
80: Laser TV
91: Top Plate
92: Front Plate
100: Gap

DETAILED DESCRIPTION

It should be noted that, unless conflicting, embodiments and features in the embodiments of the present application can be combined with each other.

It should also be noted that, hereinafter, relationship terms such as "first" and "second" are only used to distinguish one entity or operation from another, without necessarily implying any actual relationship or order between these entities or operations. Moreover, terms such as "including" and "comprising" not only include those elements explicitly listed, but also other elements that are not explicitly listed, or those inherently included in the process, method, article, or apparatus. Unless otherwise limited, the elements specified by the statement "including . . . " do not exclude other identical elements in the process, method, article, or apparatus that includes the stated elements. The terms used in the present application are generally common technical terms used by those skilled in the art. If there is any inconsistency with commonly used terms, the terms used in the present application shall prevail.

To make the purpose, technical solution, and advantages of the embodiments of the present disclosure clearer, the technical solutions in the embodiments of the present disclosure will be described clearly and completely below in conjunction with the drawings. Obviously, the described embodiments are only part of the embodiments of the present disclosure, not all of them. Based on the embodiments of the present disclosure, all other embodiments obtained by those skilled in the art without creative labor are within the scope of protection of the present disclosure.

FIGS. 1 to 8 schematically show a bidirectional flipping mechanism for a flip TV cabinet according to several embodiments of the present disclosure.

Figure 6:
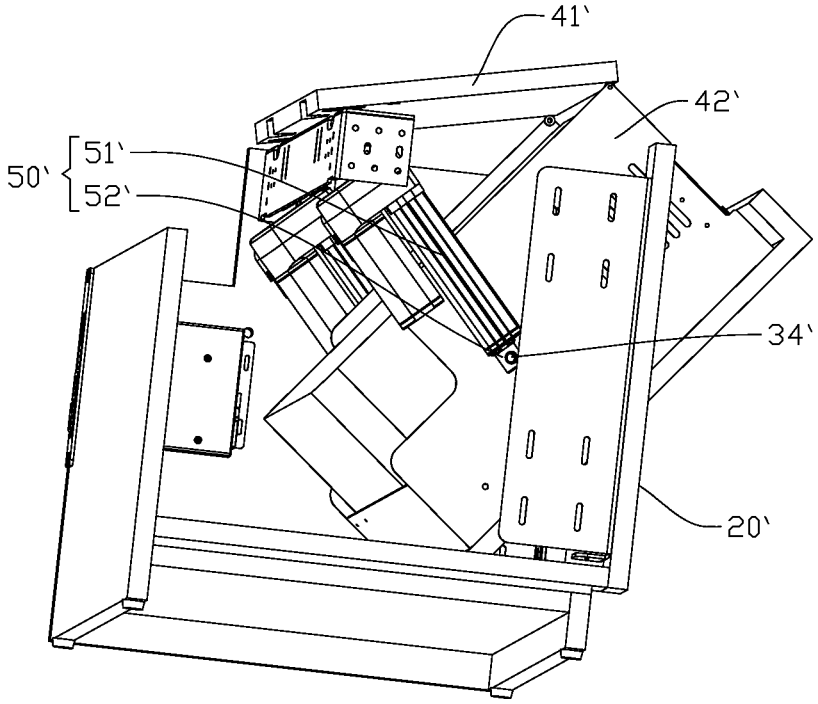
FIG. 6 is a structural schematic diagram of a first state of a bidirectional flipping mechanism for a flip TV cabinet during flipping according to another embodiment of the present disclosure.
Figure 7:
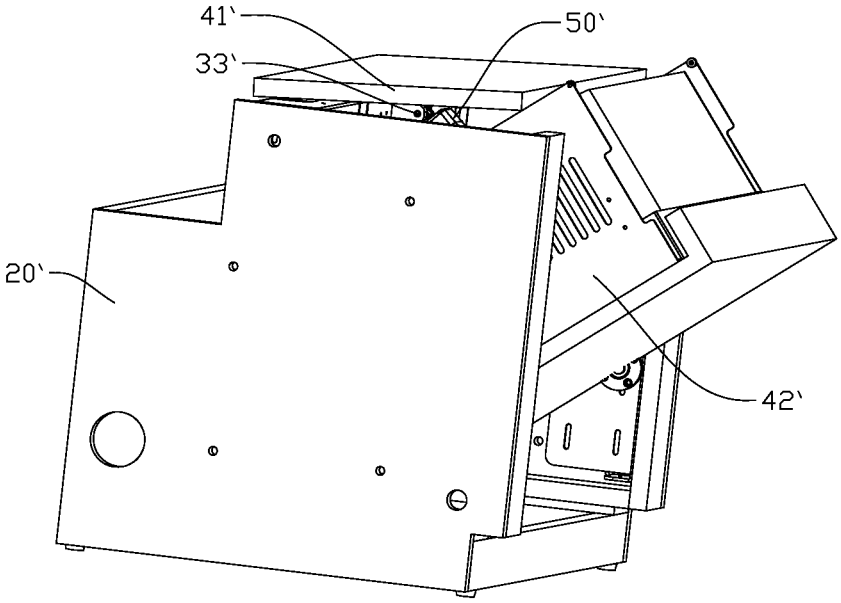
FIG. 7 is a structural schematic diagram of a second state of the bidirectional flipping mechanism for a flip TV cabinet during flipping according to another embodiment of the present disclosure.
Figure 8:
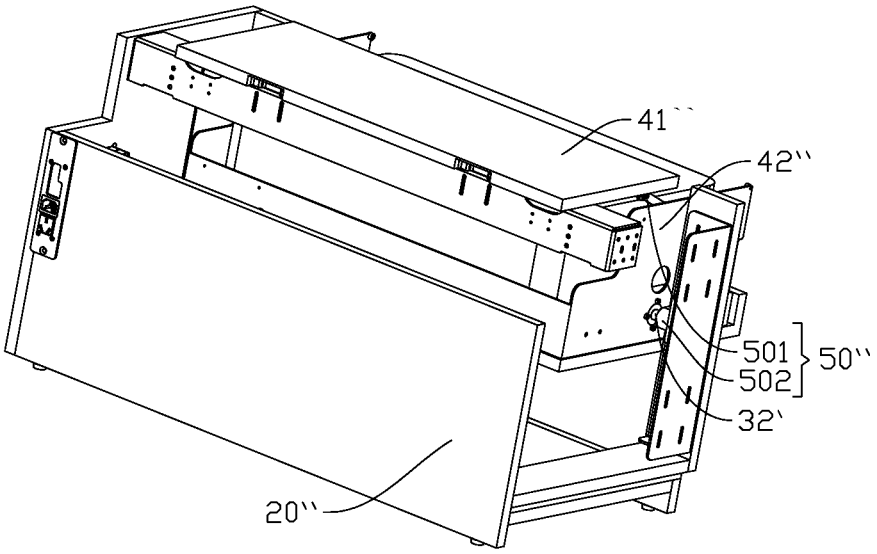
FIG. 8 is a structural schematic diagram of a bidirectional flipping mechanism for a flip TV cabinet during flipping according to yet another embodiment of the present disclosure.

As shown in FIGS. 1 to 8, the bidirectional flipping mechanism for the flip TV cabinet includes a mounting base 20, 20', 20", a first flipping member 41, 41', 41", a second flipping member 42, 42, 42" and a driving unit 50, 50', 50". The first flipping member 41, 41', 41" can be mounted on the mounting base 20, 20', 20" and pivotable around a first pivot shaft 31. The second flipping member 42, 42', 42" can be mounted on the mounting base 20, 20', 20" and pivotable around a second pivot shaft 32,32". The driving unit 50, 50', 50" is mounted on the mounting base 20, 20', 20" for driving at least one of the first flipping member 41, 41', 41" and the second flipping member 42, 42', 42" to pivot around their corresponding pivot shafts. For example, the driving unit 50 can drive the first flipping member 41 to pivot around the first pivot shaft 31 with respect to the mounting base 20. Or the driving unit 50, 50' can drive the second flipping member 42, 42' to pivot around the second pivot shaft 32 relative to the mounting base 20, 20' (as shown in FIGS. 1 to 4, 6 and 7). Alternatively, two sets of driving units 50 are provided, comprising a first driving unit 501 and a second driving unit 502. The first driving unit 501 drives the first flipping member 41" to pivot around the first pivot shaft 31 relative to the mounting base 20", and the second driving unit 502 drives the second flipping member 42" to pivot around the second pivot shaft 32" relative to the mounting base 20" (as shown in FIG. 8).

Figure 1:
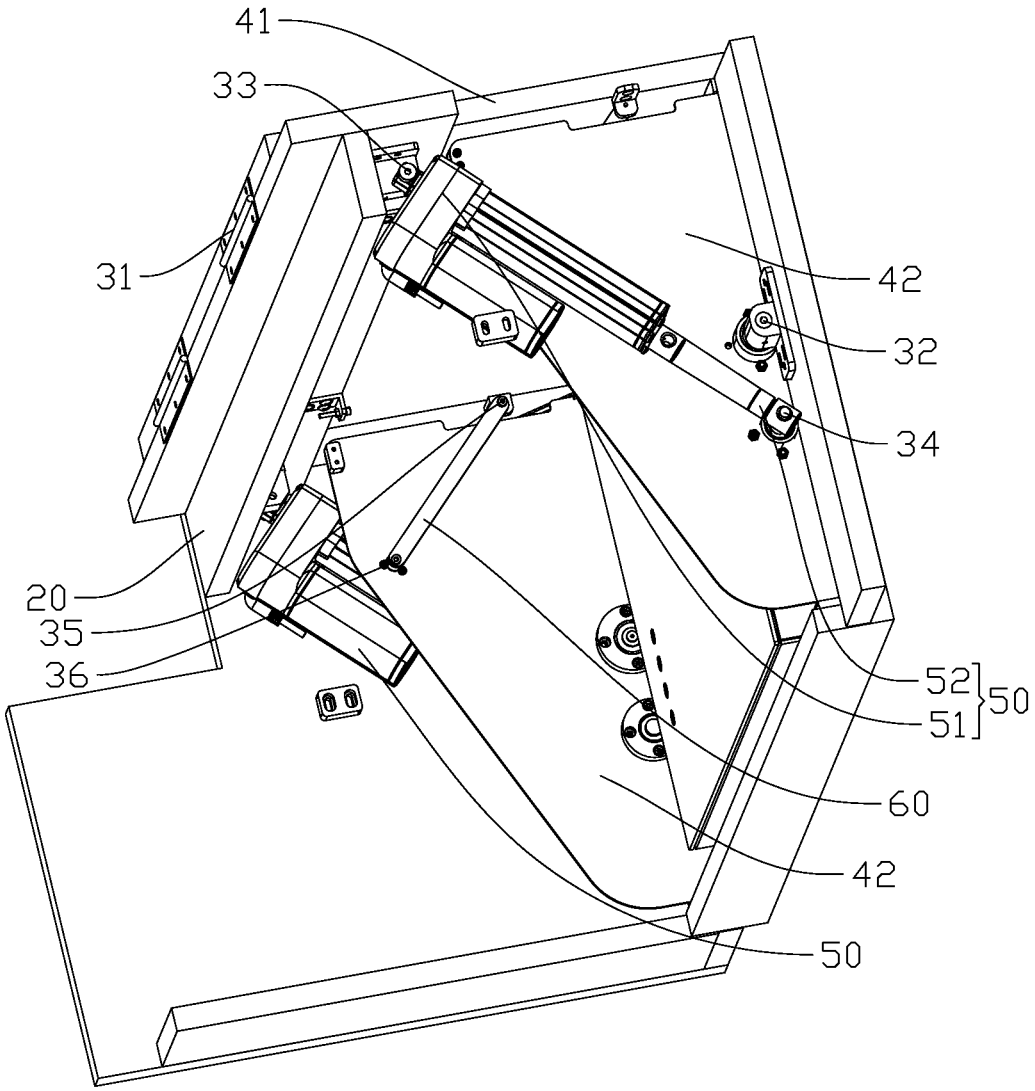
FIG. 1 is a structural schematic diagram of a bidirectional flipping mechanism for a flip TV cabinet before flipping according to an embodiment of the present disclosure.
Figure 2:
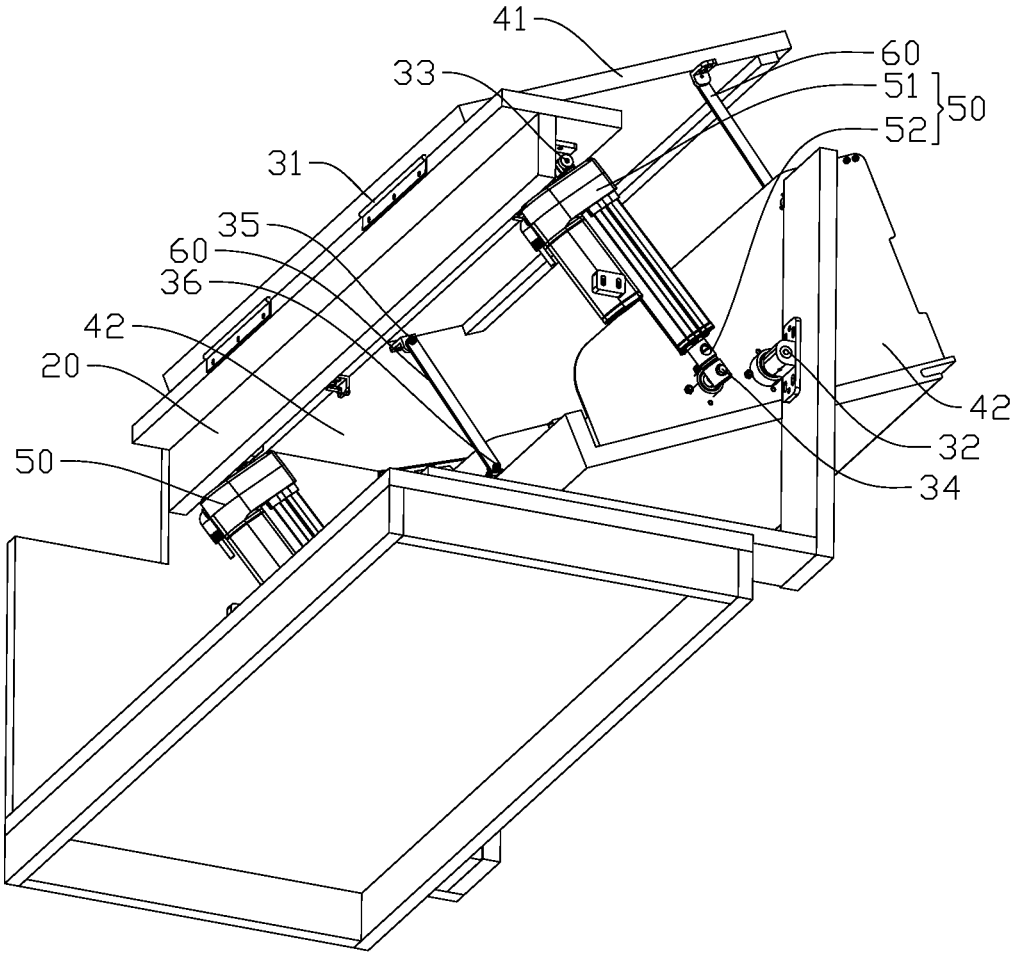
FIG. 2 is a structural schematic diagram of the bidirectional flipping mechanism for the flip TV cabinet during flipping according to an embodiment of the present disclosure.
Figure 3:
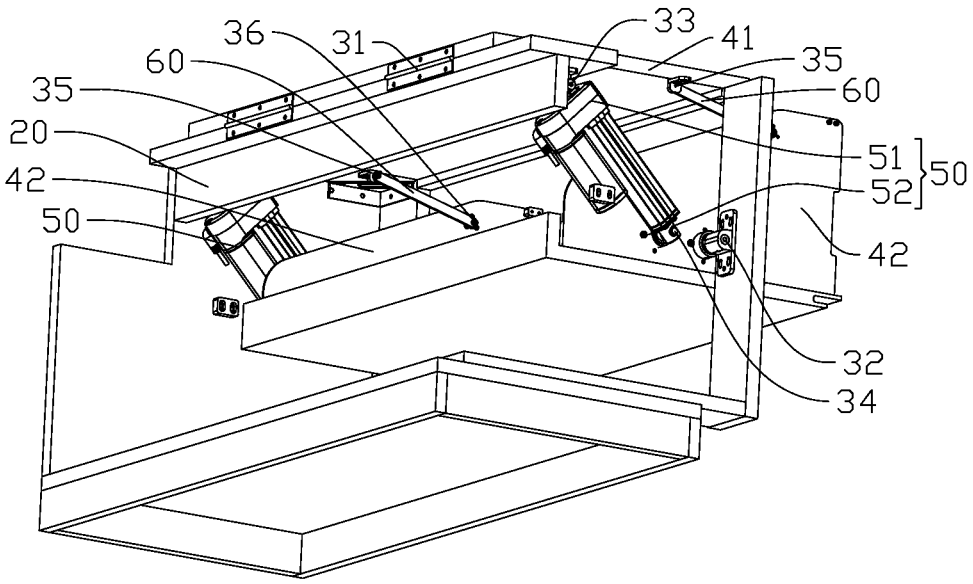
FIG. 3 is a structural schematic diagram of the bidirectional flipping mechanism for the flip TV cabinet after flipping according to an embodiment of the present disclosure.
Figure 4:
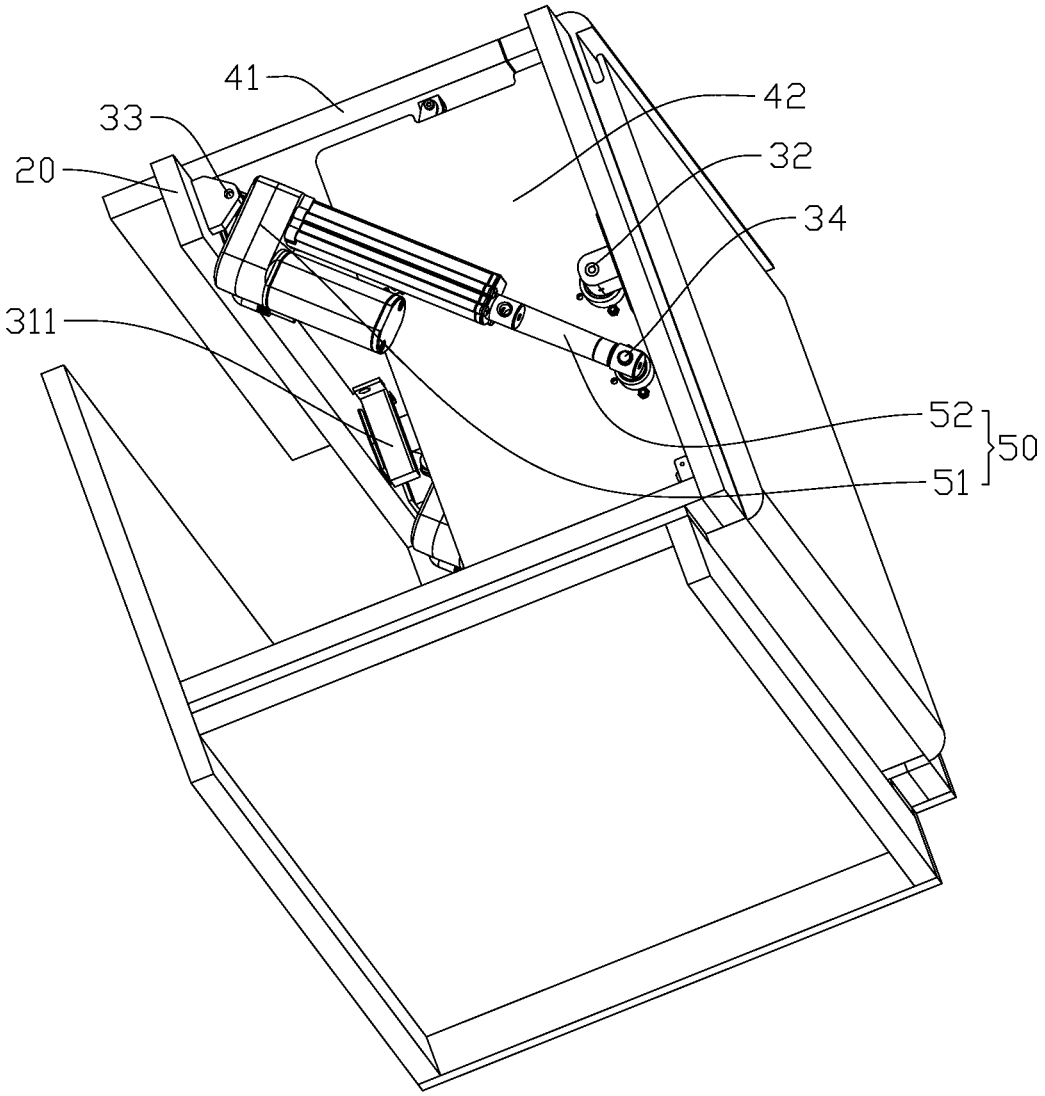
FIG. 4 is a structural schematic diagram of a bidirectional flipping mechanism for a flip TV cabinet before flipping according to another embodiment of the present disclosure.
Figure 5:
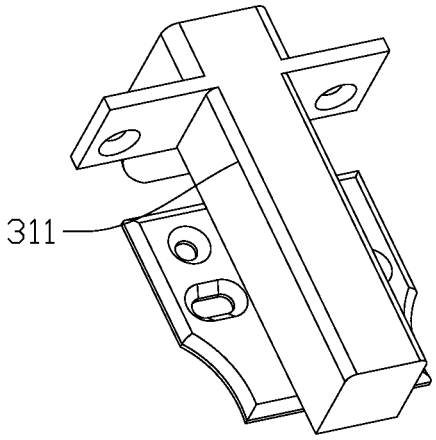
FIG. 5 is a structural schematic diagram of another implementation of a first pivot shaft of the bidirectional flipping mechanism for the flip TV cabinet shown in FIG. 4.

Exemplarily, the first flipping member 41 is provided and pivotable around the first pivot shaft 31 relative to the mounting base 20, and the second flipping member 42 is provided and pivotable around the second pivot shaft 32 relative to the mounting base 20. This can be achieved by connecting the first flipping member 41 to the mounting base 20 by means of a regular hinge (as shown in FIGS. 1 to 3) or by means of a pipe hinge (as shown in FIGS. 4 and 5), or connecting the second flipping member 42 to the mounting base 20 by means of a regular hinge. Other common pivot connection methods in the existing technology can also be used.

As one implementation of the driving unit 50, as shown in FIGS. 1 to 5, the driving unit 50 is mounted on the mounting base 20 and pivotable around a third pivot shaft 33. The driving unit 50 can also be mounted on one of the first flipping member 41 and the second flipping member 42 and pivotable around a fourth pivot shaft 34. That is, the driving unit 50 can be mounted on the first flipping member 41 and pivotable around the fourth pivot shaft 34, or the driving unit 50 can be mounted on the second flipping member 42 and pivotable around the fourth pivot shaft 34. This allows the driving unit 50 to drive one of the first flipping member 41 and the second flipping member 42 to pivot around its corresponding pivot shaft relative to the mounting base 20, while the other flipping member can pivot around its corresponding pivot shaft relative to the mounting base 20 under the action of the transmission mechanism 60. For example, when the driving unit 50 drives the first flipping member 41 to pivot around the first pivot shaft 31 relative to the mounting base 20, the second flipping member 42 can pivot around the second pivot shaft 32 relative to the mounting base 20 under the action of the transmission mechanism 60. Exemplarily, the driving unit 50 can be a mobile driving device to realize that while the mobile driving device drives the first flipping member 41 or the second flipping member 42 to move, the first flipping member 41 can also pivot around the first pivot shaft 31 relative to the mounting base 20, and the second flipping member 42 can also pivot around the second pivot shaft 32 relative to the mounting base 20. For example, the driving unit 50 includes a cylinder base 51 and a piston rod 52. For example, the driving unit 50 is an air cylinder or oil cylinder. The cylinder base 51 is mounted on the mounting base 20 and pivotable around the third pivot shaft 33, and the piston rod 52 is mounted on one of the first flipping member 41 and the second flipping member 42 and pivotable around the fourth pivot shaft 34. For example, the piston rod 52 can be mounted on the first flipping member 41 and pivotable around the fourth pivot shaft 34; or the piston rod 52 can be mounted on the second flipping member 42 and pivotable around the fourth pivot shaft 34. Thus, when the first flipping member 41 or the second flipping member 42 is driven to move by the piston rod 52, the driven flipping member can pivot around its corresponding pivot shaft relative to the mounting base 20. As another implementation of the driving unit 50", as shown in FIG. 8, the driving unit 50" is a rotation driving device, and the driving unit 50" includes a first driving unit 501 and a second driving unit 502. The rotation driving device (first driving unit 501) can be configured to drive the second flipping member 42" to pivot around the second pivot shaft 32" relative to the mounting base 20", or to drive the first flipping member 41" to pivot around the first pivot shaft 31 relative to the mounting base 20". Exemplarily, the rotation driving device can be a rotation motor, which can be fixed relative to the mounting base 20 with its base and fixed relative to either the first flipping member 41 or the second flipping member 42" with its shaft parallel to either the first pivot shaft 31 or the second pivot shaft 32.

Figure 20:
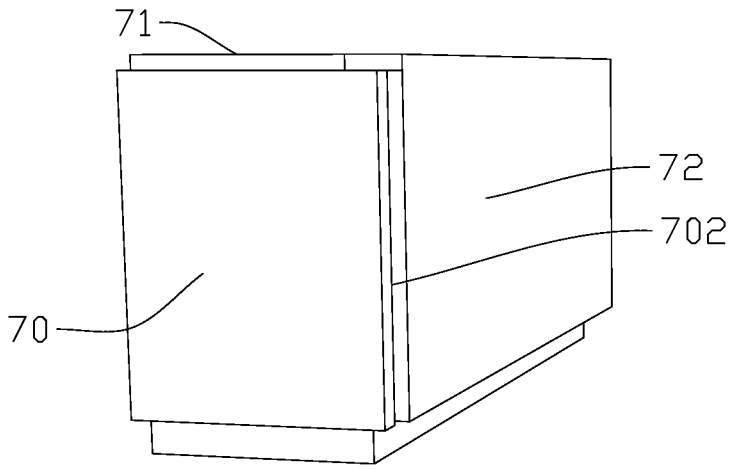
FIG. 20 is a structural schematic diagram of a bidirectional flipping mechanism for a flip TV cabinet before flipping according to an embodiment of the present disclosure.
Figure 21:
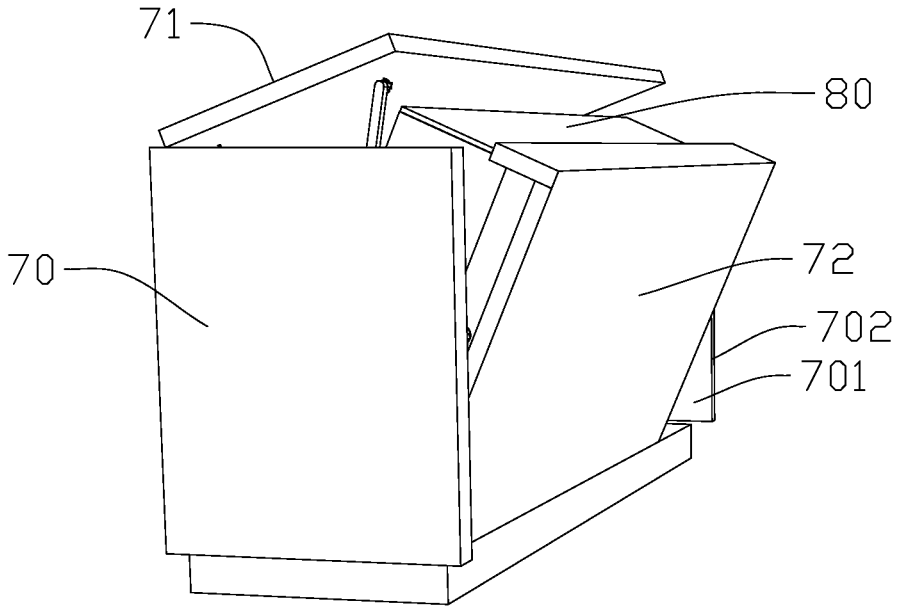
FIG. 21 is a structural schematic diagram of the bidirectional flipping mechanism for the flip TV cabinet shown in FIG. 20 during flipping.
Figure 22:
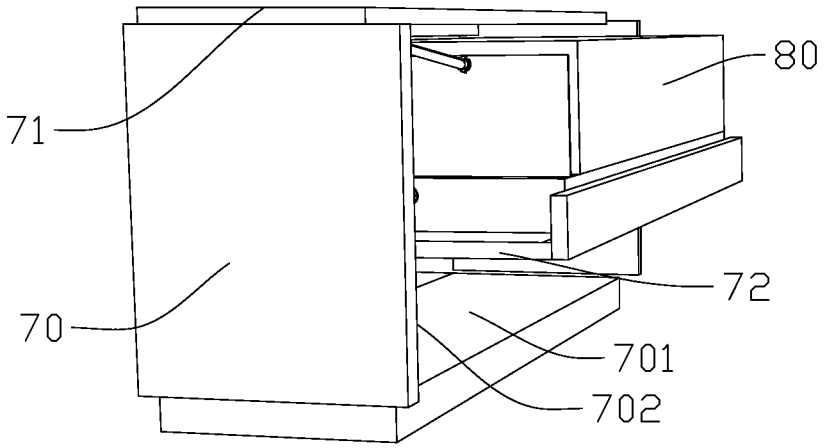
FIG. 22 is a structural schematic diagram of the bidirectional flipping mechanism for the flip TV cabinet shown in FIG. 20 when the flipping is completed.

When the bidirectional flipping mechanism is applied to a flip TV cabinet, a cover plate 71, 71', 71" (i.e., a top plate) of the TV cabinet can be fixed relative to the first flipping members 41, 41, 41", while a support plate 72, 72', 72" (which can support a laser TV 80 when placed horizontally) of the TV cabinet can be fixed relative to the second flipping members 42, 42', 42". By driving either the first flipping members 41, 41', 41" to pivot around the first pivot shaft 31 relative to the mounting base 20, 20', 20" and/or driving the second flipping members 42, 42', 42" to pivot around the second pivot shaft 32, 32' relative to the mounting base 20, 20', 20", an upper part of the laser TV 80 placed vertically on the support plate 72, 72', 72" can be as close as possible to the cover plate 71, 71', 71" of the cabinet body to reduce the overall height of the cabinet body 70, 70', 70". At the same time, when the support plate 72, 72', 72" supports the laser TV 80 vertically, the top of the support plate 72, 72', 72" can also be as close as possible to the cover plate 71, 71', 71" of the cabinet body 70, 70', 70" to avoid a large gap between the support plate 72, 72', 72" and the cover plate 71, 71', 71" (as shown in FIGS. 20 to 22), thereby ensuring the aesthetics of the cabinet body 70, 70', 70". Moreover, since the TV cabinet is a flipping type, there is no problem of a large depth of the cabinet body 72, 72', 72" and reduced aesthetics due to through holes in the front (as shown in FIGS. 9 to 13 and 18 to 22).

In some embodiments, as shown in FIGS. 6 and 7, when the driving unit 50' is configured to drive only one of the first flipping member 41' and the second flipping member 42' to pivot around its corresponding pivot shaft, one of the first flipping member 41' and the second flipping member 42' driven by the driving unit 50 to pivot around its corresponding pivot shaft can drive the other of the flipping member 41' and the second flipping member 42' to pivot around its corresponding pivot shaft. For example, when the driving unit 50' is configured to drive only the first flipping member 41' to pivot around the first pivot shaft 31, the first flipping member 41' pivoting around the first pivot shaft 31 can drive the second flipping member 42' to pivot around the second pivot shaft 32". Similarly, when the driving unit 50' is configured to drive only the second flipping member 42' to pivot around the second pivot shaft 32', the second flipping member 42' pivoting around the second pivot shaft 32' can drive the first flipping member 41' to pivot around the first pivot axis 31. Thus, for example, when the driving unit 50' is configured to drive only the second flipping member 42' to pivot around the second pivot shaft 32', and the bidirectional flipping mechanism is applied to a flip TV cabinet, the first flipping member 41' can be fixed relative to the cover plate 71', while the second flipping member 42' can be fixed relative to the support plate 72'. The second flipping member 42' can be provided on the side of the cabinet body 70', as shown in FIG. 21. When the driving unit 50' drives the second flipping member 42' and support plate 72' to pivot around the second pivot shaft 32 and the first flipping member 41' can be driven to pivot together around the first pivot shaft 31 by the second flipping member 42', support plate 72', or laser TV 80 placed on the support plate 72'.

Since the first flipping member 41' can flip, interference between the first flipping member 41', cover plate 71', laser TV 80, and support plate 72' can be avoided when the second flipping member 42' drives the support plate 72' and the laser TV 80 placed on the support plate 72' to flip. This allows the upper part of the laser TV 80 placed vertically on the support plate 72' to be as close as possible to the cover plate 71' of the cabinet body to reduce the overall height of the cabinet body 70', while also allowing the top of the support plate 72' to be as close as possible to the cover plate 71' of the cabinet body when the support plate 72' supports the laser TV 80 vertically, thereby avoiding a large gap between the support plate 72' and cover plate 71'. The specific implementation of the driving unit 50' can be similar to that of the driving unit 50 in the above-mentioned embodiment and will not be repeated here.

In other embodiments, as shown in FIGS. 1 to 3, 10 and 11, when the driving unit 50 is configured to drive only one of the first flipping member 41 and the second flipping member 42 to pivot around its corresponding pivot shaft, a transmission mechanism 60 is also provided on the first flipping member 41 and the second flipping member 42 to drive them to flip synchronously. Thus, the other flipping member can be driven to pivot around its corresponding pivot shaft relative to the mounting base 20 by the transmission mechanism 60 (for example, when the driving unit 50 drives the first flipping member 41 to pivot around the first pivot shaft 31, the second flipping member 42 can pivot around the second pivot shaft 32). This achieves the synchronous flipping of two or more flipping members with a single driving unit 50 and simplified transmission mechanism 60, thereby reducing costs and energy consumption.

In some further embodiments, as shown in FIG. 8, when the drive unit 50" is configured to drive both the first flipping member 41" and the second flipping member 42" to respectively pivot around their corresponding pivot shafts, the driving unit 50" is configured with two sets of driving units (including the first driving unit 501 and the second driving unit 502). One set (the first driving unit 501) is used to drive the first flipping member 41" to pivot around the first pivot shaft 31, and the other set (the second driving unit 502) is used to drive the second flipping member 42" to pivot around the second pivot shaft 32. This embodiment can be applied to both the solution where the driving unit 50" drives one of the first flipping member 41" and the second flipping member 42" to pivot around its corresponding pivot shaft (for example, the driving unit 50" drives the first flipping member 41" to pivot around the first pivot shaft 31), and the solution where the driving unit 50" can separately drive the first flipping member 41" and the second flipping member 42" to pivot around their corresponding pivot shafts (for example, the first driving unit 501 can drive the first flipping member 41" to pivot around the first pivot shaft 31, and the second driving unit 502 can drive the second flipping member 42" to pivot around the second pivot shaft 32). This embodiment can also be applied to the solution where the first flipping member 41 and the second flipping member 42 are driven to flip synchronously by the transmission mechanism 60.

In some preferred embodiments, the first pivot shaft 31 and the second pivot shaft 32, 32' are set parallel to each other to ensure the compactness of the overall structure.

In some preferred embodiments, the third pivot shaft 33, 33' and the fourth pivot shaft 34, 34' are provided parallel to each other to ensure the compactness of the overall structure. Preferably, when the first pivot shaft 31 and the second pivot shaft 32, 32' are set parallel to each other, the third pivot shaft 33, 33' and the fourth pivot shaft 34, 34' are parallel to the first pivot shaft 31 to further ensure the compactness of the overall structure.

In some embodiments, as shown in FIGS. 1 to 5, the transmission mechanism 60 is mounted on the first flipping member 41 and pivotable around a fifth pivot shaft 35 and mounted on the second flipping member 42 and pivotable around a sixth pivot shaft 36 to ensure the compactness of the overall structure. Exemplarily, the transmission mechanism 60 can be a support member. Preferably, when the first pivot shaft 31 and the second pivot shaft 32 are provided parallel to each other, the fifth pivot shaft 35 and the sixth pivot shaft 36 are parallel to the first pivot shaft 31 to further ensure the compactness of the overall structure. More preferably, when the first pivot shaft 31, the second pivot shaft 32, the third pivot shaft 33 and the fourth pivot shaft 34 are provided parallel to each other, the fifth pivot shaft 35 and the sixth pivot shaft 36 are parallel to the first pivot shaft 31 to further ensure the compactness of the overall structure.

In some preferred embodiments, the first pivot shaft 31, the second pivot shaft 32, the third pivot shaft 33, the fourth pivot shaft 34, the fifth pivot shaft 35 and the sixth pivot shaft 36 are not colinear to ensure the compactness of the overall structure.

FIGS. 9 to 13 schematically show a flip TV cabinet according to an embodiment of the present disclosure.

Figure 10:
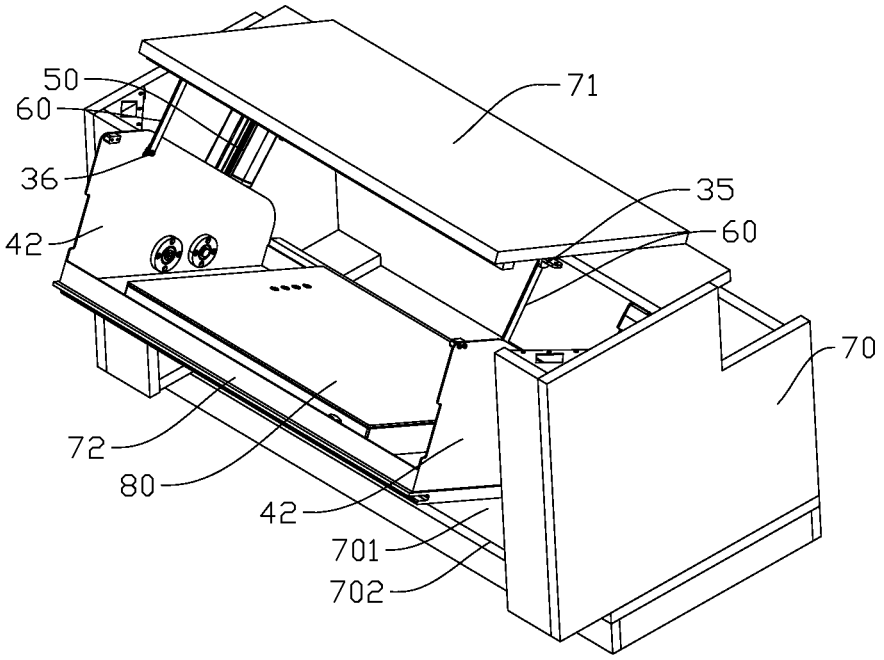
FIG. 10 is a structural schematic diagram of the flip TV cabinet provided with the bidirectional flipping mechanism for the flip TV cabinet during flipping according to an embodiment of the present disclosure.
Figure 12:
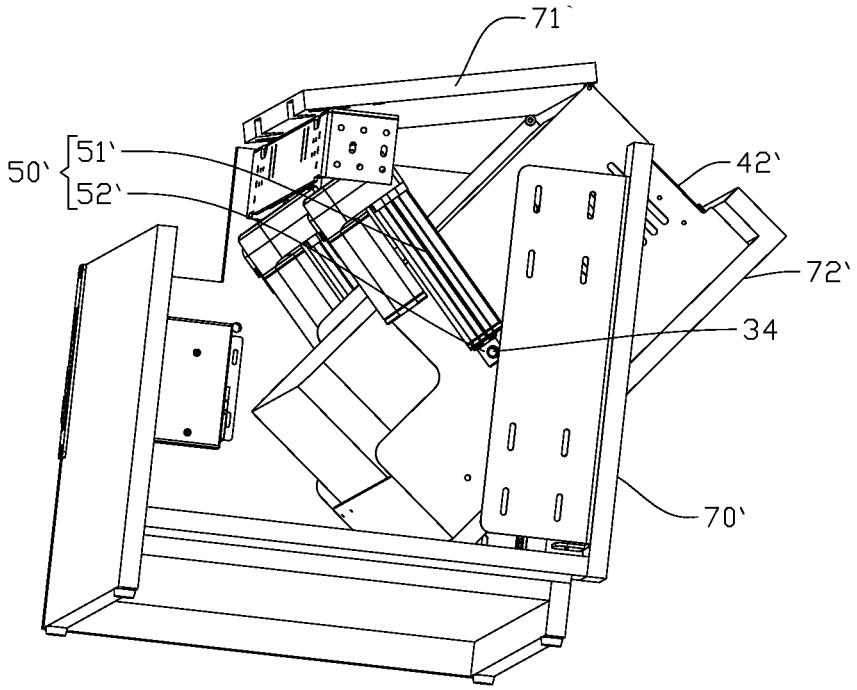
FIG. 12 is a structural schematic diagram of a flip TV cabinet provided with a bidirectional flipping mechanism for the flip TV cabinet during flipping according to another embodiment of the present disclosure.
Figure 13:
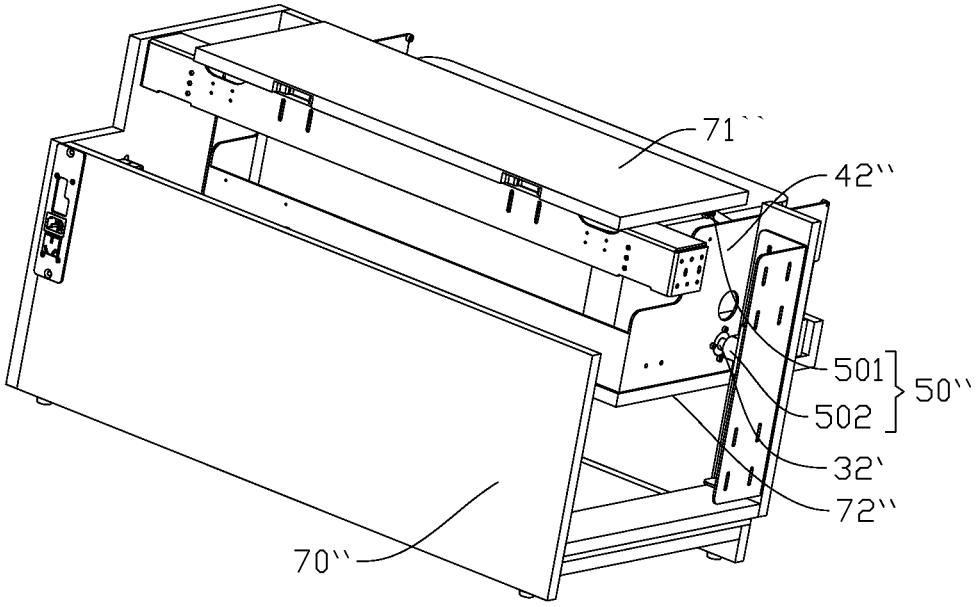
FIG. 13 is a structural schematic diagram of the flip TV cabinet provided with the bidirectional flipping mechanism for the flip TV cabinet after flipping according to another embodiment of the present disclosure.
Figure 14:
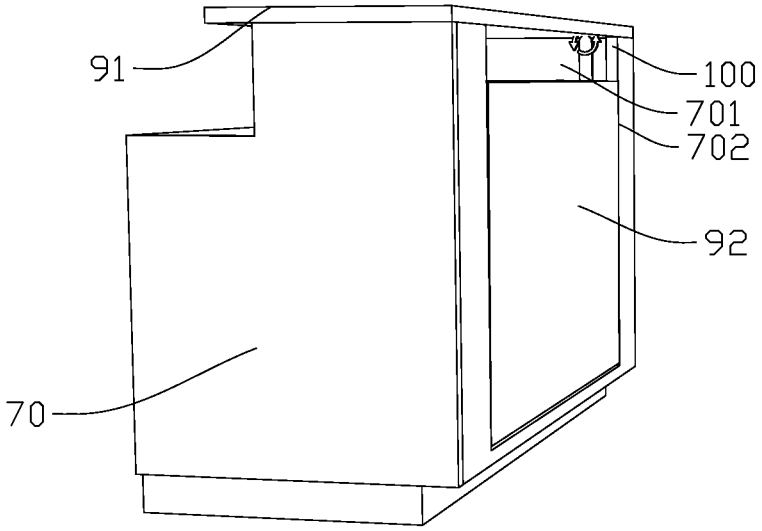
FIG. 14 is a structural schematic diagram of an existing front plate flip TV cabinet with a gap between a front plate and a top plate when the front plate is not flipped.
Figure 15:
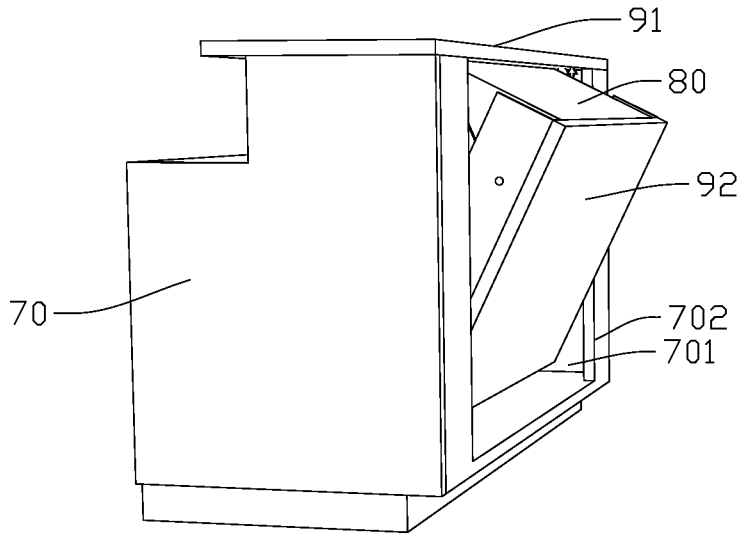
FIG. 15 is a structural schematic diagram of the front plate flip TV cabinet shown in FIG. 14 when the front plate is flipped.
Figure 16:
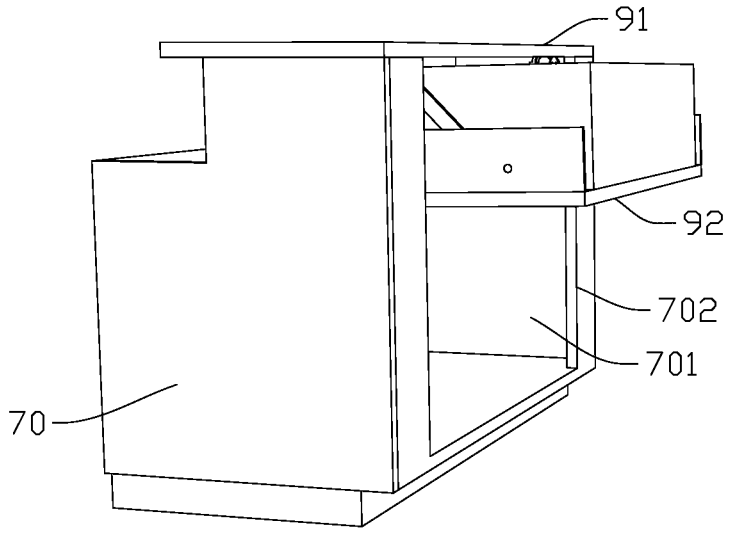
FIG. 16 is a structural schematic diagram of the front plate flip TV cabinet shown in FIG. 14 when the flipping of the front plate is completed.
Figure 17:
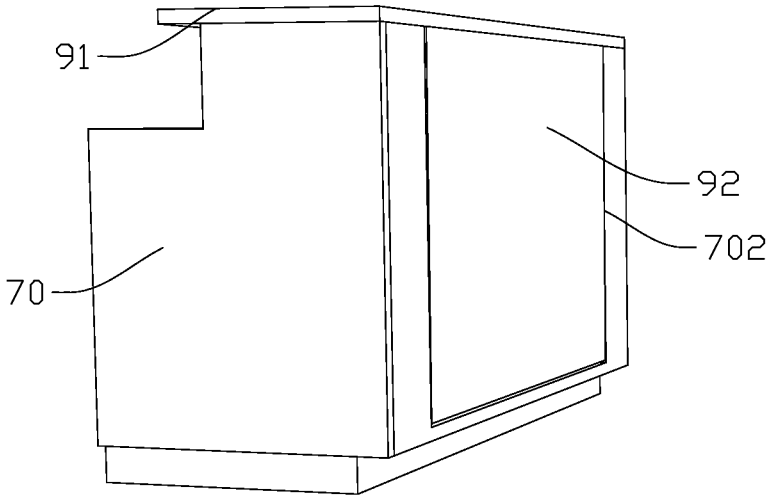
FIG. 17 is a structural schematic diagram of an existing front plate flip TV cabinet without a gap between a front plate and a top plate when the front plate is not flipped.
Figure 18:
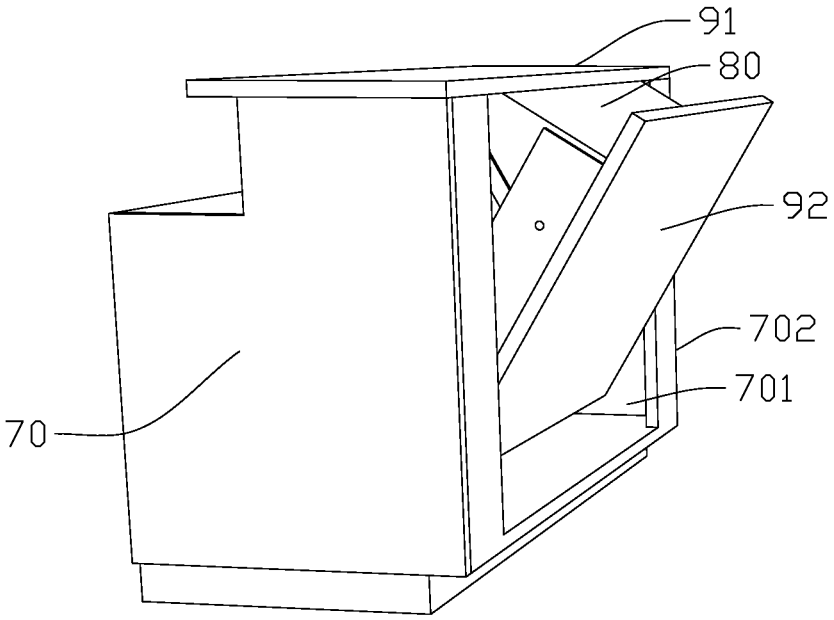
FIG. 18 is a structural schematic diagram of the front plate flip TV cabinet shown in FIG. 17 when the front plate is flipped.
Figure 19:
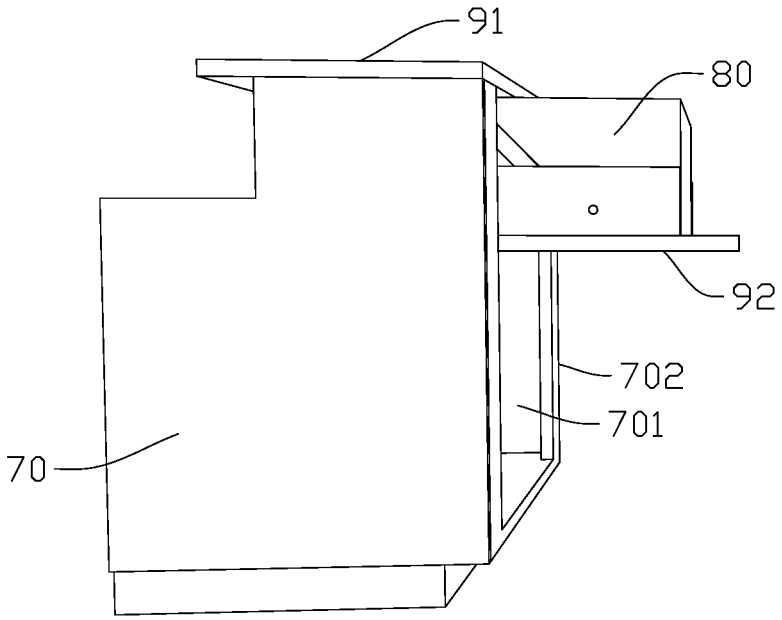
FIG. 19 is a structural schematic diagram of the front plate flip TV cabinet shown in FIG. 17 when the flipping of the front plate is completed.

As shown in FIGS. 10, 12 and 13, the flip TV cabinet includes a cabinet body 70, 70', 70", a bidirectional flipping mechanism for the flip TV cabinet, a cover plate 71, 71', 71" and a support plate 72, 72, 72". The bidirectional flipping mechanism for the flip TV cabinet is the aforementioned bidirectional flip mechanism for the flip TV cabinet. The mounting base 20, 20', 20" of the bidirectional flipping mechanism for the flip TV cabinet is fixedly mounted relative to the cabinet body 70, 70', 70". For example, the mounting base 20, 20', 20" is fixedly mounted on the cabinet body 70, 70', 70", or for example, the mounting base 20, 20', 20" is integrally molded on the cabinet body 70, 70', 70". The second flipping member 42, 42', 42" of the bidirectional flipping mechanism for the flip TV cabinet is provided on the side of the cabinet body 70, 70', 70" (e.g., front side, back side, left side or right side, preferably the front side). The cover plate 71, 71', 71" is fixedly provided relative to the first flipping member 41, 41', 41" of the bidirectional flipping mechanism for the flip TV cabinet. For example, the first flipping member 41, 41', 41" is fixedly mounted on the cover plate 71, 71', 71". As another example, the first flipping member 41, 41', 41" is integrally molded on the cover plate 71, 71', 71". The support plate 72, 72', 72" is fixedly provided relative to the second flipping member 42, 42, 42".

Thus, under the driving of the driving unit 50, 50', 50" of the bidirectional flipping mechanism for the flip TV cabinet, the cover plate 71, 71', 71" and the support plate 72, 72', 72" can be synchronously flipped by the first flipping member 41, 41', 41" and the second flipping member 42, 42, 42", respectively. The laser TV 80 can be placed on the support plate 72, 72, 72".

Figure 11:
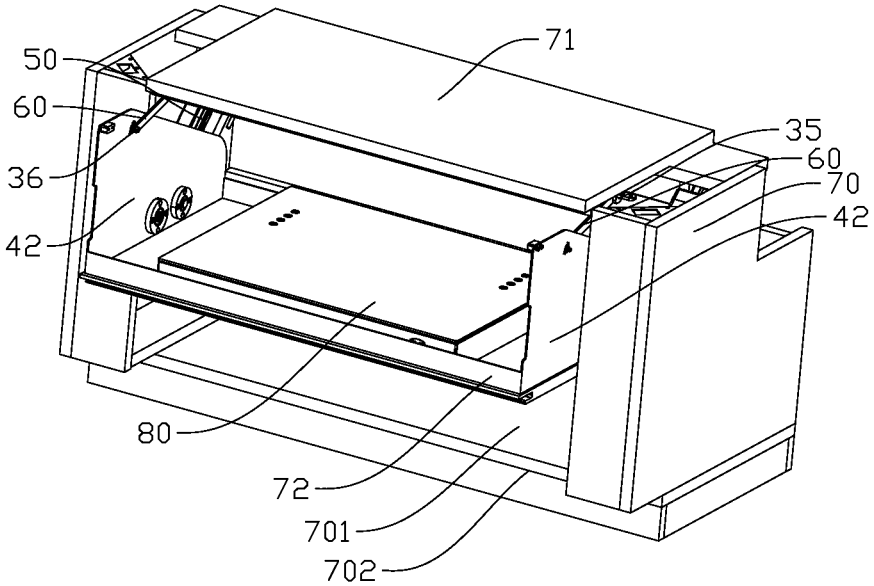
FIG. 11 is a structural schematic diagram of the flip TV cabinet provided with the bidirectional flipping mechanism for the flip TV cabinet after flipping according to an embodiment of the present disclosure.

Preferably, as shown in FIGS. 10 and 11, two second flipping members 42 are provided to ensure the stability of the second flipping member 42 driving the support plate 72 and the cover plate 71 to flip, and the two second flipping members 42 are respectively located on both sides of the cover plate 71 and the support plate 72. Both second flipping members 42 are fixedly mounted relative to the support plate 72, and each second flipping member 42 is pivotally mounted on the mounting base 20 through the second pivot shaft 32, pivotally connected to two sets of driving units 50 through the fourth pivot shaft, and pivotally connected to two sets of transmission mechanisms 60 through the sixth pivot shaft. That is, there are two sets of the second pivot shaft 32, the fourth pivot shaft 34, and the sixth pivot shaft 36. Each set of driving units 50 is also pivotally mounted on the mounting base 20 through the third pivot shaft 33, and each set of transmission mechanisms 60 is also pivotally mounted on both sides of the cover plate 71 through the fifth pivot shaft 35. Thus, there are also two sets of the third pivot shaft 33 and the fifth pivot shaft 35.

Figure 9:
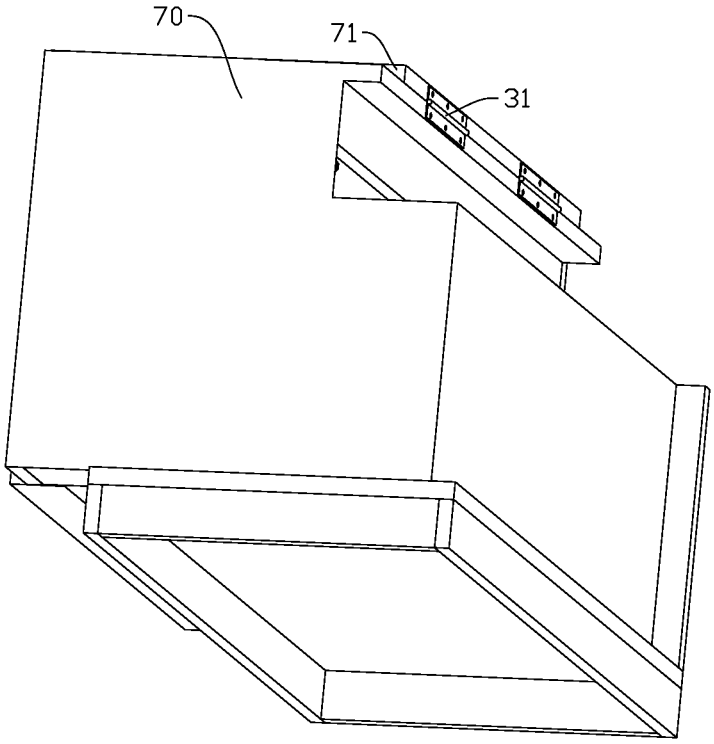
FIG. 9 is a structural schematic diagram of a flip TV cabinet provided with a bidirectional flipping mechanism for the flip TV cabinet before flipping according to an embodiment of the present disclosure.

In some preferred embodiments, the cabinet body 70, 70', 70" is integrally molded or processed with a first accommodating cavity 701 for accommodating the second flipping member 42, 42, 42" and the support plate 72, 72', 72". The cabinet body 70, 70', 70" is also integrally molded or processed with a side opening 702 communicating the first accommodating cavity 701 with the outside. Under the driving of the driving unit 50, 50', 50" of the bidirectional flipping mechanism for the flip TV cabinet, the support plate 72, 72', 72" has a first position where the side opening 702 is opened and parallel to the horizontal plane (as shown in FIG. 11), and a second position where the side opening 702 is closed (as shown in FIGS. 9 and 13). When the support plate 72, 72', 72" is in the first position, both the support plate 72, 72', 72" and the second flipping member 42, 42", 42" are at least partially located inside the first accommodating cavity 701. When the support plate 72, 72', 72" is in the first position and the second position, the cover plate 71, 71', 71" is parallel to the horizontal plane (e.g., by selecting an appropriate position of the fifth pivot shaft 35). Exemplarily, the fourth pivot shaft 34 is provided on the second flipping member 42, 42', 42", and when the support plate 72, 72', 72" is in the first position, the second pivot shaft 32, 32' and the fourth pivot shaft 34, 34' are located on the same horizontal plane (as shown in FIGS. 3, 11, and 12). When the support plate 72, 72', 72" is in the second position, the second pivot shaft 32, 32' and the fourth pivot shaft 34, 34' are located on the same vertical plane (as shown in FIG. 1). When the support plate 72, 72', 72" is in a position between the first position and the second position (as shown in FIGS. 2 and 10), the fourth pivot shaft 34, 34' are located below the second pivot shaft 32, 32', so that when the support plate 72, 72', 72" is provided on the second flipping member 42, 42', 42", the position of the support plate 72, 72', 72" can be accurately controlled by controlling.

Thus, when the support plate 72, 72', 72" is in the first position, the laser TV 80 placed thereon can be exposed for use. When the support plate 72, 72', 72" is in the second position, the laser TV 80 can be stored to maintain the compactness of the overall structure.

In the present disclosure, unless otherwise specified, connection or installation means fixed connection. The fixed connection can be realized as a detachable connection or a non-detachable connection as commonly used in the prior art. The detachable connection can be realized using existing techniques, such as a threaded connection or a key connection. The non-detachable connection can also be realized using existing techniques, such as welding or gluing.

The above described are only some embodiments of the present disclosure. For a person of ordinary skill in the art, various modifications and improvements can be made without departing from the inventive concept of the present disclosure, which fall within the scope of protection of the present disclosure.

What is claimed is:

1. A bidirectional flipping mechanism for a flip TV cabinet, comprising:

a mounting base, wherein the mounting base is fixedly provided relative to a cabinet body of the flip TV cabinet;

a first flipping member mounted on the mounting base and pivotable around a first pivot shaft, wherein the first flipping member is fixedly provided relative to a cover plate of the flip TV cabinet;

a second flipping member mounted on the mounting base and pivotable around a second pivot shaft, wherein the second flipping member is fixedly provided relative to a support plate of the flip TV cabinet;

a driving unit mounted on the mounting base, wherein the driving unit is configured to drive the first flipping member to pivot around the first pivot shaft, and/or the driving unit is configured to drive the second flipping member to pivot around the second pivot shaft;

the second flipping member driven by the driving unit is capable of driving the first flipping member to pivot around the first pivot shaft when pivoting around the second pivot shaft; or, the bidirectional flipping mechanism further includes a transmission mechanism provided on the first flipping member and the second flipping member, the transmission mechanism being configured to drive the first flipping member and the second flipping member to flip synchronously under the driving of the driving unit; or, the driving unit comprises a first driving unit and a second driving unit, the first driving unit driving the first flipping member to pivot around the first pivot shaft, and the second driving unit driving the second flipping member to pivot around the second pivot shaft;

the cabinet body is provided with a first accommodating cavity for accommodating the second flipping member and the support plate, and the cabinet body is further provided with a side opening communicating the first accommodating cavity with the outside;

the support plate has a first position where the side opening is opened and parallel to a horizontal plane and a second position where the side opening is closed when driven by the driving unit of the bidirectional flipping mechanism for the flip TV cabinet, and the support plate and the second flipping member both are at least partially located inside the first accommodating cavity when the support plate is in the first position;

the cover plate is parallel to the horizontal plane when the support plate is in the first position and the second position.

2. The bidirectional flipping mechanism for a flip TV cabinet according to claim 1, wherein the first pivot shaft and the second pivot shaft are provided parallel to each other.

3. The bidirectional flipping mechanism for a flip TV cabinet according to claim 1, wherein the driving unit is mounted on the mounting base and is pivotable around a third pivot shaft, the driving unit is provided on at least one of the first flipping member and the second flipping member and is pivotable around a fourth pivot shaft, and the driving unit is configured to drive at least one of the first flipping member and the second flipping member mounted thereon to move while pivoting around the fourth pivot shaft; or the first driving unit is configured to drive the second flipping member to pivot around the second pivot shaft with respect to the mounting base, or the second driving unit is configured to drive the first flipping member to pivot around the first pivot shaft with respect to the mounting base.

4. The bidirectional flipping mechanism for a flip TV cabinet according to claim 2, wherein the driving unit is mounted on the mounting base and is pivotable around a third pivot shaft, the driving unit is provided on at least one of the first flipping member and the second flipping member and is pivotable around a fourth pivot shaft, and the driving unit is configured to drive at least one of the first flipping member and the second flipping member mounted thereon to move while pivoting around the fourth pivot shaft; or the first driving unit is configured to drive the second flipping member to pivot around the second pivot shaft with respect to the mounting base, or the second driving unit is configured to drive the first flipping member to pivot around the first pivot shaft with respect to the mounting base.

5. The bidirectional flipping mechanism for a flip TV cabinet according to claim 4, wherein the third pivot shaft and the fourth pivot shaft are parallel to the first pivot shaft.

6. The bidirectional flipping mechanism for a flip TV cabinet according to claim 5, wherein the driving unit comprises a cylinder base and a piston rod, the cylinder base being mounted on the mounting base and pivotable around the third pivot shaft, and the piston rod being mounted on one of the first flipping member and the second flipping member and pivotable around the fourth pivot shaft.

7. The bidirectional flipping mechanism for a flip TV cabinet according to claim 5, wherein the transmission mechanism is provided on the first flipping member and is pivotable around a fifth pivot shaft, and the transmission mechanism is provided on the second flipping member and is pivotable around a sixth pivot shaft.

8. The bidirectional flipping mechanism for a flip TV cabinet according to claim 7, wherein the fifth pivot shaft and the sixth pivot shaft are parallel to the first pivot shaft, and the first pivot shaft, the second pivot shaft, the third pivot shaft, the fourth pivot shaft, the fifth pivot shaft and the sixth pivot shaft are not colinear.

9. A flip TV cabinet, comprising:

a cabinet body;

the bidirectional flipping mechanism for a flip TV cabinet according to claim 1, the mounting base of which is fixedly provided relative to the cabinet body, and the second flipping member is provided at the side of the cabinet body;

a cover plate fixedly provided relative to the first flipping member of the bidirectional flipping mechanism for the flip TV cabinet; and a support plate fixedly provided relative to the second flipping member;

the second flipping member driven by the driving unit is capable of driving the first flipping member to pivot around the first pivot shaft when pivoting around the second pivot shaft; or, the bidirectional flipping mechanism further includes a transmission mechanism provided on the first flipping member and the second flipping member, the transmission mechanism being configured to drive the first flipping member and the second flipping member to flip synchronously under the driving of the driving unit; or, the driving unit comprises a first driving unit and a second driving unit, the first driving unit driving the first flipping member to pivot around the first pivot shaft, and the second driving unit driving the second flipping member to pivot around the second pivot shaft;

the cabinet body is provided with a first accommodating cavity for accommodating the second flipping member and the support plate, and the cabinet body is further provided with a side opening communicating the first accommodating cavity with the outside;

the support plate has a first position where the side opening is opened and parallel to a horizontal plane and a second position where the side opening is closed when driven by the driving unit of the bidirectional flipping mechanism for the flip TV cabinet, and the support plate and the second flipping member both are at least partially located inside the first accommodating cavity when the support plate is in the first position;

the cover plate is parallel to the horizontal plane when the support plate is in the first position and the second position.

10. The flip TV cabinet according to claim 9, wherein the driving unit is mounted on the mounting base and is pivotable around a third pivot shaft, the driving unit is provided on at least one of the first flipping member and the second flipping member and is pivotable around a fourth pivot shaft, and the driving unit is configured to drive at least one of the first flipping member and the second flipping member mounted thereon to move while pivoting around the fourth pivot shaft; or the first driving unit is configured to drive the second flipping member to pivot around the second pivot shaft with respect to the mounting base, or the second driving unit is configured to drive the first flipping member to pivot around the first pivot shaft with respect to the mounting base.

11. The flip TV cabinet according to claim 10, wherein the driving unit comprises a cylinder base and a piston rod, the cylinder base being mounted on the mounting base and pivotable around the third pivot shaft, and the piston rod being mounted on one of the first flipping member and the second flipping member and pivotable around the fourth pivot shaft.

12. The flip TV cabinet according to claim 10, wherein the transmission mechanism is provided on the first flipping member and is pivotable around a fifth pivot shaft, and the transmission mechanism is provided on the second flipping member and is pivotable around a sixth pivot shaft.

13. The flip TV cabinet according to claim 12, wherein the fifth pivot shaft and the sixth pivot shaft are parallel to the first pivot shaft, and the first pivot shaft, the second pivot shaft, the third pivot shaft, the fourth pivot shaft, the fifth pivot shaft and the sixth pivot shaft are not colinear.

* * * * *